United States Patent [19]

Gibbar, Jr.

[11] Patent Number: 4,924,641

[45] Date of Patent: May 15, 1990

[54] POLYMER BUILDING WALL FORM CONSTRUCTION

[76] Inventor: James H. Gibbar, Jr., 1100 Lottes Blvd., Perryville, Mo. 63775

[21] Appl. No.: 176,650

[22] Filed: Apr. 1, 1988

[51] Int. Cl.[5] ..... E04C 2/26; E04B 2/44; E04B 2/26

[52] U.S. Cl. ..... 52/204; 52/251; 52/258; 52/262; 52/295; 52/300; 52/309.12; 52/275

[58] Field of Search ..... 52/309.12, 405, 295, 52/300, 309.7, 275, 258, 204, 251, 262

[56] References Cited

U.S. PATENT DOCUMENTS

| | | | |
|---|---|---|---|
| 1,682,360 | 8/1928 | Straub | 52/612 X |
| 3,003,199 | 10/1961 | Talmey | 52/309.7 |
| 3,239,982 | 3/1966 | Nicosia | 52/309.7 |
| 3,475,873 | 11/1969 | Steadman | 52/562 |
| 3,717,967 | 2/1973 | Wood | 52/259 |
| 3,755,982 | 9/1973 | Schmidt | 52/309.11 |
| 3,800,015 | 3/1974 | Sachs | 52/309.12 |
| 4,038,798 | 8/1977 | Sachs | 52/309.7 |
| 4,156,372 | 5/1985 | Grutsch | 52/562 |
| 4,234,634 | 11/1980 | Longinotti | 52/309.12 |
| 4,426,061 | 1/1984 | Taggart | 52/309.12 |
| 4,604,843 | 8/1986 | Ott | 52/309.12 |
| 4,731,971 | 3/1988 | Terkl | 52/309.12 |

FOREIGN PATENT DOCUMENTS

| | | | |
|---|---|---|---|
| 1138616 | 1/1983 | Canada | 52/309.12 |
| 2324915 | 12/1974 | Fed. Rep. of Germany | 52/309.12 |

*Primary Examiner*—John E. Murtagh
*Attorney, Agent, or Firm*—Paul M. Denk

[57] ABSTRACT

A polymer building or other structured wall form construction wherein forms prefabricated of polymer, such as polystyrene, are assembled together, spaced apart by integrally connecting polymer or blocks or spacers, erected upon a foundation footing, or other base structure, through their insertion upon L-shaped ties, with the wall forms being erected to the desired height for the subject building or other structure, through the application of tee-shaped ties therebetween. Reinforcement is located in the spacing between the blocks of the wall forms, and concrete may be poured therein, to provide a latticework of reinforced concrete for the composite wall. A top beam form of plate cap is arranged upon the upper edge of the formed wall, with a concrete beam being poured simultaneously with the construction of the assembled wall. Bracing held together by ties and locked into position by fasteners secure the wall forms together, in their erected disposition, in preparation for the pouring of the latticework of concrete reinforced composite wall.

27 Claims, 6 Drawing Sheets

POLYMER BUILDING WALL FORM CONSTRUCTION

BACKGROUND OF THE INVENTION

This invention relates generally to a composite wall fabrictated of a combination of polymer forms, providing a latticework of voids therein, and into which concrete can be poured, to provide a monolithic wall structure that is fully supportive of the building, its roof, and yet of significantly reduced cost due to the uniqueness of its fabrication.

A large number of wall structures, designed to ease and reduce the expense of fabrication of building walls, foundation walls, or the like, have long been available in the art. For example, the United States to O'Beirne, discloses an interlocking concrete panel. As can be seen therein, the various blocks apparently are designed to be interfitted together, within its panel structure, but obviously, since polymers and plastics were not available at the time, such blocks and panels were fabricated of other materials. It provides spacing within the blocks where concrete could be filled therein, during the formation of its intended wall. The panels that form the wall constitute the completed wall's inner and outer faces, as can be seen in said patent, but the particular materials from which these panels were fabricated do not appear to be explained in the identified patent. Nevertheless, the patent does disclose flange means that tie the panels together, interfitting within key-like grooves, meaning that apparently the panels are left in place, once the concrete is poured intermediate the inner and outer faces of the wall formed by the shown panels.

The patent to Langenberg, U.S. Pat. No. 2,181,698, discloses another form of wall construction In the particular design as disclosed, it appears that the wall, once again, is formed of various inner and outer slabs, which are interlocked together by means of connecting ties. It is shown that the slabs themselves are constructed of concrete, as can be noted in their cross section within the identified patent. Concrete is then poured between the slabs during the formation of the disclosed wall.

The patent to Wheeler-Nicholson, U.S. Pat. No. 3,149,437, discloses another form of building construction. The forms used therein are quite complex, of fabrication, but do include various interior panels between inner and outer panels, and which function for a modular fitting for connecting of the next adjacent wall panels together. Concrete is then poured therein, and the building fabricated from the type of wall that can be constructed to include window apertures, that are fabrication during the formation of the constructed wall.

The patent to Goldman, U.S. Pat. No. 3,220,151, shows a building unit with laterally related interfitting panel sections. This patent shows that the panels may be molded of any cementitious material, or may be fabricated of any suitable plastic material, in their construction. The panels include a series of integrally formed lugs, which apparently interfit together, when the panels are located into position, as shown. Concrete is then poured therein, to provide for the desired wall structure, and it would appear that lugs are integrally formed upon their various panel interior surfaces, and that the panels do remain in place after a foundation has been poured. It would also appear that reinforcing rods might fit through various apertures provided in the panels, for reinforcement purposes. In addition, the patent does explain that various voids may be provided for furnishing of window and door apertures.

The patent to Gregori, U.S. Pat. No. 3,552,076, discloses another type of concrete form. As can be noted, the various units may be fabricated of a polymer, such as polystyrene, and which are placed in layers to provide and accommodate the pouring of concrete therein. And, since there are a variety of partition walls that are integrally structured into the units, these particular units are designed for permanent installation, and provide insulation for the building in which they are arranged. Each of the partitions further appear to include recesses for holding horizontally emplaced steel reinforcing rods, in preparation for pouring of the concrete internally of the various units.

The patent to Liester, U.S. Pat. No. 3,584,826, discloses another form of concrete wall forming apparatus and method. This particular device includes a series of half forms, as can be noted, which are located and placed adjacent each other, and thereby provide circular spacings intermediate the forms wherein concrete is poured. This particular structure, although formed of a series of these formed members, in their configuration, are similar to the construction and structure of panels that are generally marketed in the trade under the trademark Luxit, by a Swiss company of the same name, which utilizes polystyrene wall panels, emplaced together, and having a series of horizontal and vertical cavities therein, and into which concrete is poured in the formation of a wall. Another patent identified belonging to the said Swiss company is U.S. Pat. No. 4,439,122.

Another patent to Liester, U.S. Pat. No. 3,689,021, discloses another type of apparatus for concrete wall construction. It utilizes forms incorporating various open cells constructed into the shape of the forms that apparently are made of polyurethane. But, it also appears that the object of these type of formed walls is to provide a see-through form type of concrete wall construction, meaning that the forms are apparently removed once the wall is constructed. It also appears that the particular designed wall is more for ornamental wall or fence purposes, rather than as a building wall construction.

The patent to Gregori, U.S. Pat. No. 3,788,020, discloses a foamed plastic concrete type of form with fire resistant tension members. As can be noted therein, the particular develop form functions as a concrete form, made of foamed polymeric material, and which is left in place to function as insulation, for the wall, when constructed after concrete has been poured within its internal cavities.

The United States patent to Francis, U.S. Pat. No. 3,908,326, shows a development entitled "A Brick Panel Construction". The development appears to be more of a surface type brick panel that provides a facade over a concrete or other poured wall. It does show extensions at the end of the panel, apparently for overlapping each other, when assembled into position.

The United States patent to Lount, U.S. Pat. No. 4,229,920, shows another type of foamed plastic concrete form and connectors therefor. These panels are made of foamed plastic, and include their specific style of anchor members therebetween, so that a pair of the panels are held in spaced position when concrete is poured within them.

The United States patent to Taggart, U.S. Pat. No. 4,426,061, shows another form of method and apparatus for forming insulated walls. The development discloses the use of adjacent sheets of insulating material, held in position by means of tie holders, that are structured for supporting cross members, such as the beams as disclosed. Various apertures in the form of windows and doors can also be constructed into the structure, through the usage of the shown development.

The United States patent to Dielenberg, U.S. Pat. No. 4,439,967, discloses an apparatus relating to building form work. This particular device, as shown, is formed of a series of interlocking blocks, held together by various corner and tee connections, and which are formed of hard foam resin material that has high insulating properties. Within the blocks are provided spacings in which concrete is poured.

The United States patent to Doran, U.S. Pat. No. 4,577,447, shows a construction block, formed as building block, and apparently constructed of polystyrene beads. The blocks, as shown, have a series of upstanding members formed upon the surface of each half member, with each having either a protubrance, or a recess, so that the half members can be interfitted together during fabrication.

The patent to Schneller, U.S. Pat. No. 4,578,915, shows another form of exterior wall It describes a method for forming an exterior wall of a building, constructed of high density rigid sheathing board, affixed to vertical studs, and having a wall structure of laminated concrete-stucco provided thereon.

The patent to Young, U.S. Pat. No. 4,706,429, discloses a permanent non-removable insulating type concrete wall forming structure. The wall as shown therein is likewise formed of a modular synthetic plastic, for providing a concrete formed structure, held apart by means of particular types of attachment means, in the form of plastic ties, and into which concrete can be poured. One can also note that the side and upper surfaces of the shown panels are designed for mating with the next adjacent panels.

Finally, various publications have defined the construction of foam homes, which are generally panels prefabricated of foam material, and which are interfitted together into some type of geodesic shape for furnishing a building structure.

It is, therefore, the principal object of the current invention to provide a prefabricated type of wall, that combines the usage of a wall form, formed of a pair of sheet-like material, preferably constructed of polystyrene, with one of the sheets incorporating integrally prepositioned blocks or spacing elements, so that the wall can be immediately assembled through the interconnecting of a variety of these wall forms together, braced into position, supported in alignment by means of a variety of ties, which are strapped together to assure a precise thickness for the completed wall, for receiving the deposition of concrete therein, to provide a monolithic wall which is both structurally reinforced through a combination of concrete latticework, formed within the polymer wall forms, all of which add significant insulative value to the reinforced wall during any building's occupancy.

Another object of this current invention is to provide a series of wall forms, of significant size, which can be interconnected together into both lateral adjacency, and vertically stacked, being braced by means of bracing means, to provide a unique formed wall in preparation for deposition and reception of a reduced amount of concrete therein, and of significant size to accommodate the development and construction of a building of either small or large capacity.

Another object of this invention is to provide a series of wall forms that can be constructed into the fabrication of a concrete wall, and greatly enhance its insulative value during usage.

Still another object of this invention is the provision of a variety of unique accessories for use in conjunction with a polymer wall form, for use for constructing a monolithic concrete-polymer wall, and which accessories provide for the convenient emplacement of the various wall forms into position, their assembling together, when fabricated into an overall form in preparation for the pouring of the concrete therein during building wall construction.

Another object of this current invention is to provide a one-piece polystyrene wall panel, for use as a form, for constructing of a load bearing wall, when concrete has been poured therein, and which wall can be constructed to continuous lengths, or even heights, depending upon the size of building specified and required.

Another object of this invention is to provide the fabrication of a building wall, formed of a composite of concrete and polymer wall forms, which significantly reduces building costs, and its erection time, thereby providing efficiency in the labor costs entailed.

Still another object of this invention is to provide a permanent and insulated reinforced concrete wall constructed of polymer panels and wall forms.

Still another object of this invention is to provide a wall form, constructed preferably of polystyrene polymer material, which has high insulative value to it, thereby allowing for the pouring of the concrete latticework therein even when subjected to temperature extremes.

Still another object of this invention is to provide a wall form, which when combined together for formation of an overall wall structure, requires a minimum of reusable bracing for interlocking the same together during wall construction.

Another object of this invention is to provide a wall form that may be combined into a composite concrete wall structure, and which has by design a thermal resistant value of at least R35.

Still another object of this invention is to provide a composite wall formed of concrete and polymer and which requires no special tools or equipment in its installation, assembly, and construction.

Yet another object of this invention is to provide a composite wall which may have designed into it any size or positioned openings and into which may be located prefabricated doors or windows as required by necessity or code.

A further object of this invention is to provide a monolithic concrete and polymer wall having high insulative value, as previously explained, thereby reducing utility and insurance costs.

Still another object of this invention is to provide wall forms, preferably constructed of polymer, such as polystyrene material, and which may have added to it various flame-retardant materials, to add to its factor of safety.

Still another object of this invention is to provide a monolithic wall of concrete and polymer, which has high shear strength, wind resistance, and also incorporates reinforcement structure that may be earthquake resistant.

Yet another object of this invention is to provide a combined polymer and concrete wall that may function as a foundation wall for a building.

Another object of this invention is to provide a process setting forth a procedure for creating a monolithic concrete wall incorporating polymer forms.

These and other objects may become more apparent to those skilled in the art upon reviewing the summary of this invention, and upon undertaking a study of the description of its preferred embodiment in view of the drawings.

SUMMARY OF THE INVENTION

This invention contemplates the formation of wall forms, preferably constructed of a polymer, and more specifically of a polymer such as foam urethane, but preferably polystyrene, and which wall forms are fabricated of a pair of sheet material, which in the preferred embodiment, is generally constructed in sheets measuring four feet by eight feet in dimension, or larger. One of these sheets incorporates, integrally, during its formation, a series of blocks or spacers formed therein, and which extend that distance away from the interior surface of its sheet, to provide the thickness for the concrete wall to be poured therein, to that dimension which is compatible with code requirements, and which will assure the strength required for the designed reinforced concrete and composite wall of this invention. Again, in the preferred embodiment, these blocks or spacers are generally of a dimension of six inches by twelve inches in cross section, and have a width of approximately eight inches, so that any concrete that is poured within the formed wall, once erected, will provide a latticework of concrete reinforcement therein, having a thickness of at least eight inches in dimension. Obviously, other thicknesses may be specified.

In the construction of the wall form of this invention, and in the desired configuration, the pairs of sheet material that are brought together to form the wall, and its form, are provided for furnishing a permanent interior panel, and a similar exterior panel, for the intended wall construction. The interior panel, since it will be exposed to lesser than rigorous conditions within the interior of any building to be formed through this construction, may be made of less dense material, and therefore, in the preferred embodiment, where polystyrene is utilized in the construction of the interior sheets, a one pound density polystyrene material is useful and has been found adequate, for the fabrication of this particular component of the wall. The exterior panel, on the other hand, which is subjected to the rigors or exterior exposure, may be formed of a more denser polystyrene, which, in the preferred construction, may be fabricated of two pound, more or less, density polystyrene beads. In addition, in the formation of the polystyrene panels, and even its spacers, or in the formation of the styrene beads themselves, it may be desirable to include various other ingredients, such as flame-retardant chemicals, processed integrally within the polystyrene materials, in order to add to the inflammable characteristics of any wall and building constructed in accordance with the forms of this invention. Such flame-retardant materials are readily available in the art, and may include such chemical modifying agents such as the various phosphorous compounds, and other related chemicals, useful for this purpose. These additives may also include gypsum, chlorine or bromine derivatives, and polycarbonates, as examples. In addition, other additives may include a fungicide, and a bacteriacide, useful for resistant to fungus growth or insect infestation, particularly in the polymer components of this composite wall, in order to assure its more enduring life.

Inherent in the subject matter of this development are the methods and means by which the various wall forms are integrated together, in the formation of an overall wall structure, and wherein, obviously, while the forms of the preferred embodiment of this invention may be of approximately four feet by eight feet in dimension, a building wall may be of substantially greater size. Hence, a plurality of these wall forms will need be interconnected together, to form the overall dimension for the building wall, and various ties are generally incorporated at either the bottom of the entire wall structure, when initially assembled, and between the other horizontally disposed upper and lower edges of vertically adjacent forms, when a higher wall is designed, to assure their positioning and alignment for functioning as a structurally sound wall form, in preparation for pouring of concrete therein. The ties provided at the bottom of the wall forms are generally of L-shape, are designed for resting directly upon the foundation footing, and stradle substantially equidistant from any reinforcing rods that may have been previously embedded within the footing, during its pouring, and which extend upwardly for tying into the eventual concrete poured foundation wall. In addition, a series of straps of designed length link between each pair of L-shaped tees, at various predetermined spacings apart, and have a distance between their upright flanges equivalent or just slightly greater than the overall dimension of the polymer wall form, so that the wall form can easily slide and be inserted within the L-shaped ties, when assembling the forms for the construction of the desired wall.

Between vertically disposed adjacent wall forms, upwardly from the bottom, and where they are mounted one upon the other to provide height for the contemplated wall, the ties are in the shape of a tee, spaced apart the same distance as the L-shaped ties, by means of a series of arranged straps, so that a pair of aligned tees can be easily inserted onto the upper edge of a wall form, that is, upon the upper edge of each of the sheets of each subjacent wall form, and have the next upwardly adjacent wall forms easily inserted thereon, when erecting the wall form for the intended wall. Thus, as can be readily observed, the wall forms can be easily assembled, one upon the other, in order to add vertical height to the structured wall, and in addition, can be aligned laterally with respect to each other, being held into position by means of the emplaced L-shaped ties and tee-shaped ties, to provide a reasonably stable wall, formed of the polystyrene forms of this invention, all in preparation for the deposit or pouring of wet and flowable concrete therein, in fabrication of the overall composite wall structure.

Obviously, before any concrete is poured into the structure, and as the wall forms are being erected, variously arranged reinforcement, such as reinforcing rods, will be inserted therein, generally arranged through the wall forms, provided normally equidistant or centrally between the sheets of the wall forms, and tied into position, either upon the upstanding reinforcing rods extending from the footing, or connecting onto the various tie straps, as previously explained, to achieve their positioniong, and to assure that they remain aligned in position, when concrete is being poured therein. In addition, reinforcement, such as reinforcing rods, will likewise be bent around the corners of any formed wall, within the wall forms, during their assembly.

The corner of an intended wall structure can be easily fabricated to that particular angle, such as a ninety degree turn, customarily built into the corner of a building. This can be done with the current invention, simply by cutting the wall forms to a designated bevel, generally at forty-five degree angle, so that the ends of the bevelled wall forms will compatibly mate together, to form a right or other angled wall, or to what other angle has been designed into the building structure, for assuring a completed wall around the perimeter of the building through the usage of this particular invention.

In addition, and before any high density concrete is poured into the arranged forms, it is desirable to brace the structured wall forms into position, and generally at their end seams, where they meet in adjacency with the next aligned forms, and upright bracing, in the design of a two by fours, will be located into position, a tie means extended through the wall forms, and located through an aperture provided aligned within each of the interior and exterior located bracing, and then held into position by means of a removable fastener, which structurally secure the wall forms together into the structured wall, in preparation for pouring of concrete, but which can be readily removed, by removing of the fasteners, and displacing of the bracing, once the poured concrete has been deposited, and hardened, within the composite wall structure. Thus, as can be readily determined, very little is wasted in the fabrication of a wall from the prefabricated polymer wall forms of this invention, during application It is further likely that other components need to be built into the wall structure, to comply with architectural designs, such as the fabrication of doors and windows within the wall structure, or even the provision of a top beam plate cap, one which is adequately reinforced, for supporting of roof or ceiling girders thereon, during building construction This can be achieved by providing forms upon the upper edge of the intended top of the wall forms, or the upper edge of the intended building wall, as constructed, and then have poured therein additional concrete, fully reinforced by rods, at this upper segment, to provide the style of top beam necessary to adequately support a plurality of roof girders, and the heavy weight of a roof, during building assembly. In addition, various header boards, jambs, sills, and the like, can be framed into the wall structure, cut through the wall forms during their assembly, to provide apertures within the structured wall, even after concrete is poured, and into which prefabricated doors or window sets can be readily installed, during building fabrication. It is also likely, and within the contemplation of this invention, that the polystyrene or other polymer forming the sheets of the wall forms of this development can be further treated, and either coated with a gypsum, a polyvinyl resin, or any other type material, that may be useful for providing a finished surface onto the used sheets, such as to form the interior wall of the building, as for its intended purpose. For example, a polyvinyl spray may be applied or laminated onto a certain segment of the interior sheet of the wall forms, in order to withstand refrigerated temperatures where the building may be used for low temperature operations. In addition, gypsum or wall board may be applied to the various ties, once emplaced, by means of any standard dry wall application means, or other clips, in order to provide a finished interior wall for the building. Likewise, the exterior of the building may have coated upon it any type of cementitious material, such as stucco, or have a grid work of netting or wire or other related type of material to which stucco may be readily applied, in order to afford a finished exterior surface to the building. In addition, it is likely that the usual thermal or moisture barrier may be applied to the exterior sheet of the wall forms, once the wall has been formed into a composite concrete structure, and have masonry applied in adjacency therewith.

It should be readily observable from reviewing this invention, its drawings, and from the description of its preferred embodiment, that the subject matter of this invention is to provide a series of wall forms, constructed of a pair of inner and outer sheets, having spacers therebetween, integrally formed extending from one of the sheets, and which provides a latticework of voids within each wall form, and which are in communication with the voids contained within the horizontally and vertically adjacent wall forms, all of which form a latticework of voids into which concrete may be poured in the construction of the monolithic and reinforced wall of this invention. The type of concrete used in the fabrication of the wall, in the preferred embodiment, has been found to be a mix of six bags of cement per yard of the desired concrete. Furthermore, in order to assure that the concrete has fluidity to it, and will flow into all of the various voids contained within the erected wall forms, other additives may be blended in with the wet concrete, such as a material entitled "Sarabond", obtainable from Dow Chemical Company, of Midland, Mich., and which adds to the fluid flow of concrete, when applied for the purposes of this invention. Although, the inventor has found that such an additive is really not needed to achieve the desired results of his development.

DESCRIPTION OF THE PREFERRED EMBODIMENT

Figure 3:
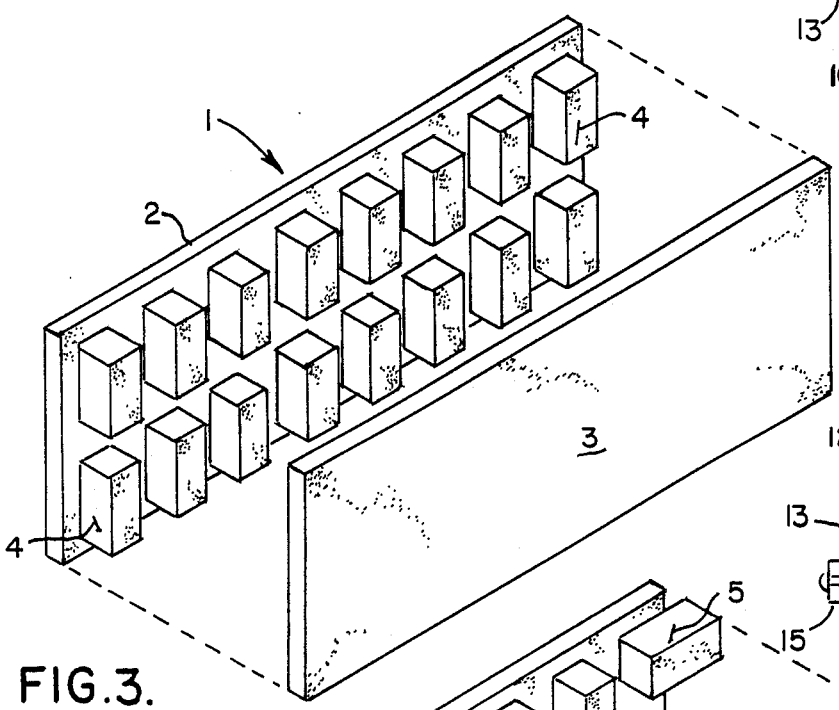
FIG. 3 is an exploded view of one of the wall forms of this invention, showing its two sheets, and the integral blocks or spacers extending from the interior of one of said sheets.

In referring to the drawings, and in particular FIG. 3, the basic configuration for the wall forms 1 of this invention are disclosed, and as can be seen, and as previously summarized, includes a pair of sheets, 2 and 3 of polymer material, such as polystyrene, and which may have a thickness to that extent which adds sufficient rigidity to the form, when placed into workable condition, for holding a supply of concrete as poured therein. In a preferred embodiment, the thickness of said sheets may be in the vicinity of one to three inches, with approximately a two inch thick sheet having been found to be adequate. One of the sheets, and usually the exterior sheet, has integrally formed thereon, also of polystyrene, a series of blocks or spacer means, as at 4, and which are designed to provide for the necessary spacing between the form sheets, and which eventually provides the thickness of the concrete latticework poured therein, during formation of a wall. Normally, in the preferred embodiment, the sheets will have the thickness as previously explained, and have a rectangular dimension of approximately four feet by eight feet. Although, for obvious reasons, these dimensions may vary. In addition, the blocks may have a dimension of approximately six inches by twelve inches, and have an eight inch thickness to provide for that spacing between the sheets 2 and 3, for reasons as previously explained. The dimensions between blocks are also approximately six inches, in order to provide adequate clearance and a latticework of voids into which the concrete will easily flow, when pouring the reinforced concrete wall of this development. The blocks are also spaced approximately three inches from the sheet edges, in order to complimentary be dimensioned approximately six inches from the next adjacent blocks of the adjacent wall forms, when located into their operative and installation positions. The sheet with integral blocks may then be glued or otherwise adhered to the other sheet to form a complete wall form unit.

Figure 4:
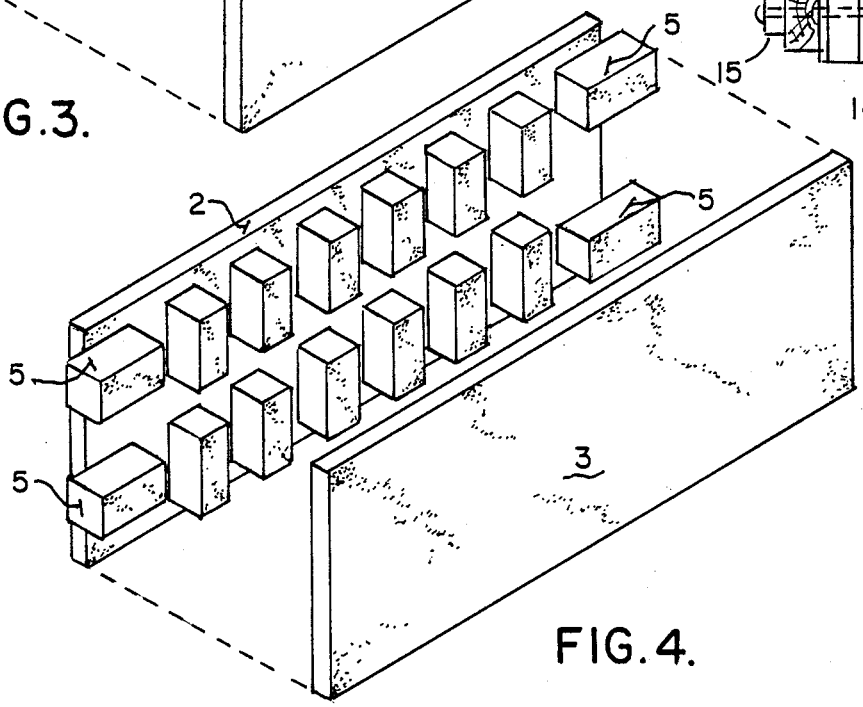
FIG. 4 is an exploded isometric view of a slightly modified wall form of this invention, as shown in FIG. 3, but wherein a number of the blocks or spacers at the lateral edges of the form are extended, in order to straddle within the next laterally adjacent wall forms for purposes of stabilization.

As can be seen in FIG. 4, the end blocks 5 of the sheets 2 and 3 extend some distance externally of the edges of the shown polystyrene sheets, and thereby may extend into the next laterally adjacent wall forms, in order to provide stability between laterally positioned forms, during their installation and assembly.

Figure 1:
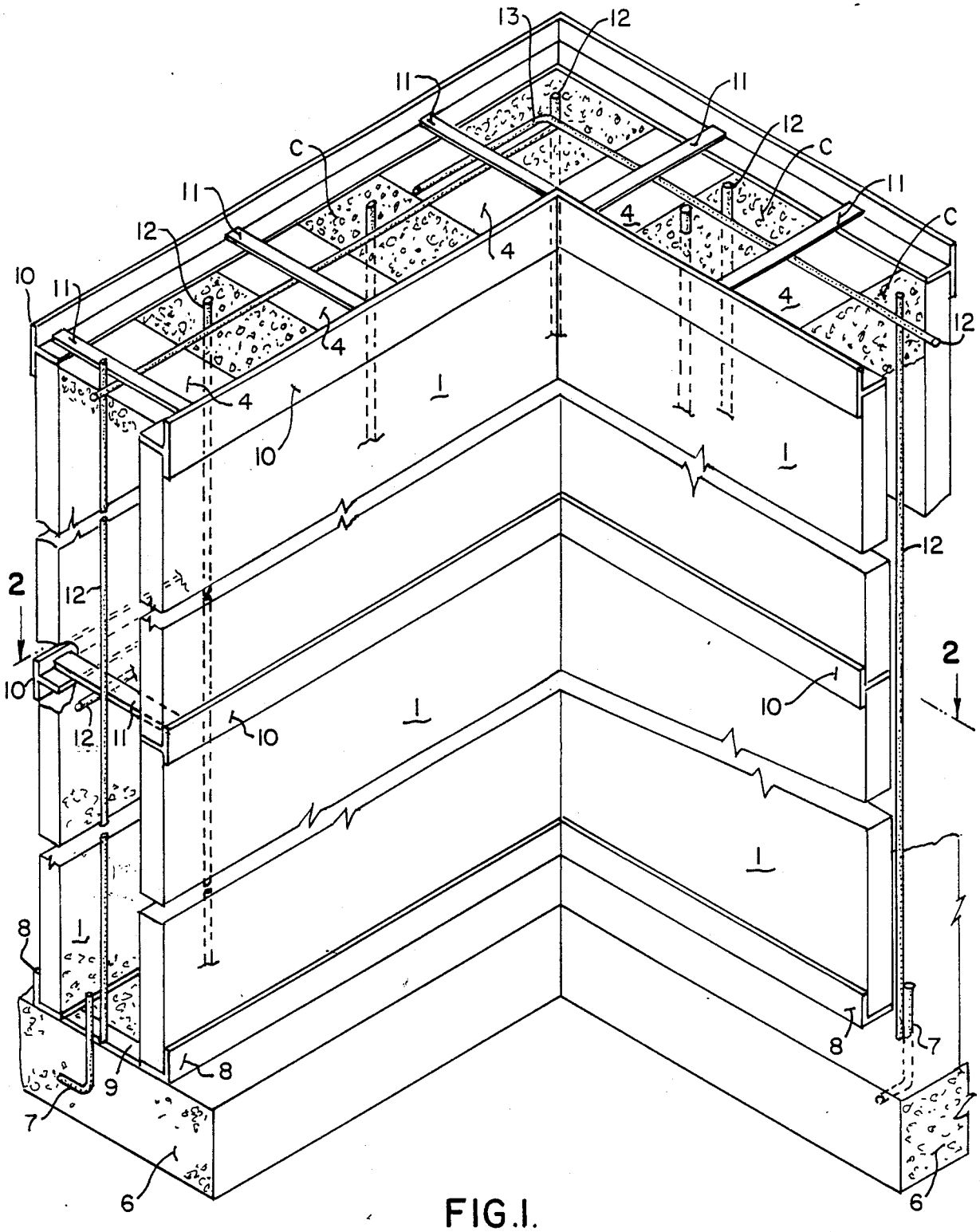
FIG. 1 is an isometric view of the wall forms, at a building corner, containing a supply of poured concrete therein, in the fabrication of a composite wall under development utilizing the principle of this invention.

As can be seen in FIG. 1, a variety of the wall forms 1 are disposed for vertical installation, one upon the other, as for example, when a building having an approximate eight foot height is required, two such of the forms may be installed, one upon the other, to provide a wall of this height. A footing 6 will have been previously excavated and poured into position, as noted, and various reinforcing rods, or rebars, as shown at 7, will have been previously installed, and located at that position where they will be centrally arranged within any fabricated wall constructed in accordance with the teachings of this invention. In addition, in order to conveniently align the wall forms upon the footing 6, a series of L-shaped ties, as at 8, will be positioned upon the footing, and a series of straps, one as shown at 9, are fixed to each of the shaped ties 8, at predetermined distances apart, in order to provide that convenient width dimension between the ties and into which the lowermost wall forms 1 may insert, during their installation before the pouring of any concrete wall therein. Obviously, these shaped ties 8 may extend for significant distances, preferably being of greater length than the wall forms 1, so as to span the abutting edges between adjacent wall forms, and add to their convenient and aligned installation within the prefabricated wall form structure.

As can also be noted, a series of tee-shaped ties 10, spaced apart by means of their shown straps 11, are then conveniently interfitted upon the top edge of the lowermost wall forms 1, and in this manner conveniently align and readily accept any upper wall form 1 for its installation, when completing the fabrication of the formed wall, constructed of these polystyrene units, in preparation for the pouring of fresh concrete therein As can further be seen in FIG. 1, such tee-shaped ties 10 are also separated by means of the said series of straps 11, and may be interfitted upon the top or upper edge of the uppermost wall form, in preparation for the arrangement and pouring of a top beam plate cap thereon, in the manner as will be subsequently described. In any event, as can be seen, once the wall forms 1 are conveniently installed, upon their selectively implaced L-shaped or tee-shaped ties, as can be noted, the formed wall of these polystyrene units is ready for location of the various rebars, such as the latticework of reinforcement rods 12, as can be seen. These rods may extend both vertically and horizontally within the wall structure, preferably within the voids between the various blocks or spacer means 4, in preparation for pouring of concrete therein. As can also be noted, the lowermost reinforcing rods 12 may be tied into the assembly of rebars 7, extending from the footings, and it is also likely, as at the intended corner of a building, the rebars may be turned, as noted at 13, and tied into a vertical or other horizontally disposed reinforcement rods thereat, to provide adequate structural strength, for the building, at the corner structure.

As can be noted at FIG. 1, once the entire wall assembly is fabricated, and as further shown in FIG. 3, the interior of the fabricated wall forms contains a variety of vertically and horizontally disposed latticework of voids, and into which the concrete C is poured, and flows, during the completion of monolithic wall structure, being fabricated of the combination of polymer, and concrete, in the manner as shown and described herein.

Figure 2:
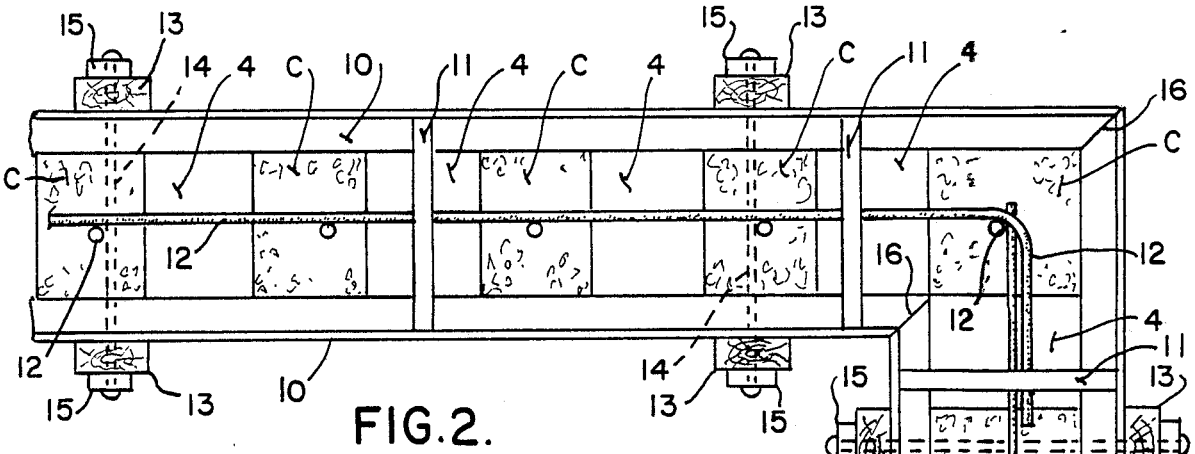
FIG. 2 is a top plan view thereof, but also showing bracing utilized to support the wall forms during their initial erection, and before and during the pouring of any concrete therein.

As can be seen in FIG. 2, the corner of the wall structure, as shown in FIG. 1, is generally displayed, and the upper tee-shaped ties 10 with their spacing straps 11 are generally disclosed. In addition, at least the blocks or spacer means 4 are adequately disclosed, between the latticework of poured concrete, as at C. The grid work of rebars 12 are likewise disposed, having been previously positioned before the pouring of any of the shown concrete therein.

In the assembly of the wall forms of this invention, and particularly at predetermined positions along the length of the forms, bracing, as at 13, is required, in order to position and hold the wall forms into their erected location, and to further reinforce against any bulging of the forms during pouring and curing of the concrete therein. Each of these bracings 13 are generally a length of two by four, or wood bracing of other dimension, and to a height equivalent to the height of the intended wall. These bracing are held into position by means of the pre-extension of tie means 14 through the wall forms, and likewise through aligned apertures provided within the bracings 13, and then held into position by means of removable fasteners, as at 15, which, as previously summarized, once the wall is erected, the concrete poured, and cured, the fasteners may simply be removed, the bracing 13 removed, and the extending ends of emplaced tie means 14 may simply be bent free and broken from the constructed wall. Preferably this will be performed without causing too much damage to the surface of the polystyrene sheets within the vicinity of their proximate surface.

Figure 5A:
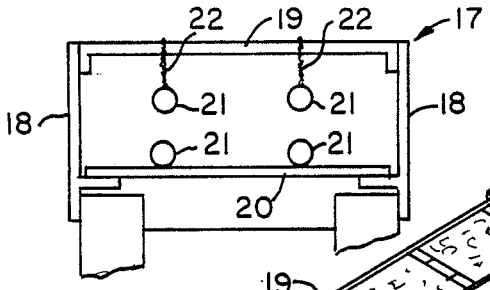
FIG. 5A provides an end view of the upper top beam cap plate that is formed along the upper edge of any wall formed in accordance with the teachings of this invention.
Figure 5:
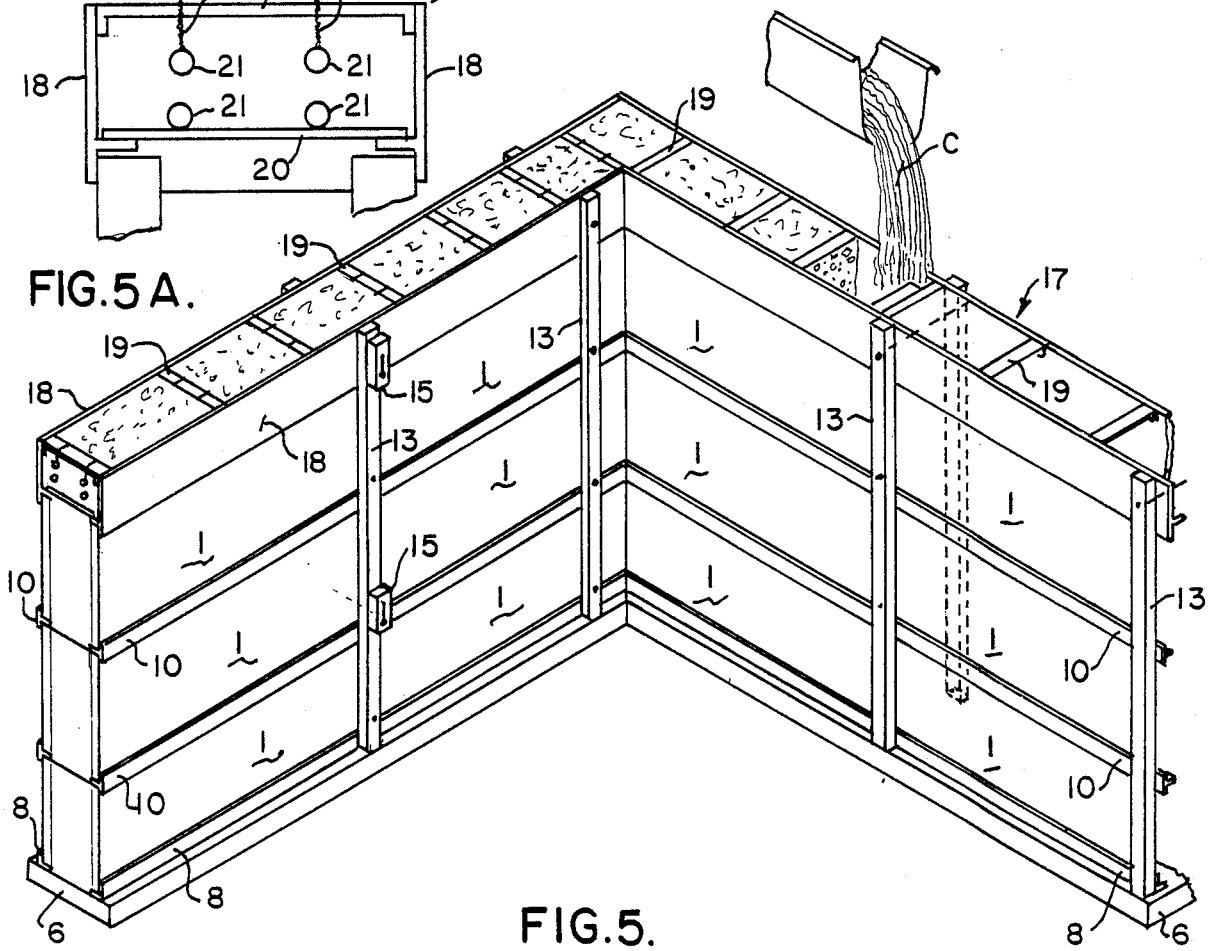
FIG. 5 shows an isometric view of a wall form at a corner in the process of having concrete poured therein.
Figure 7:
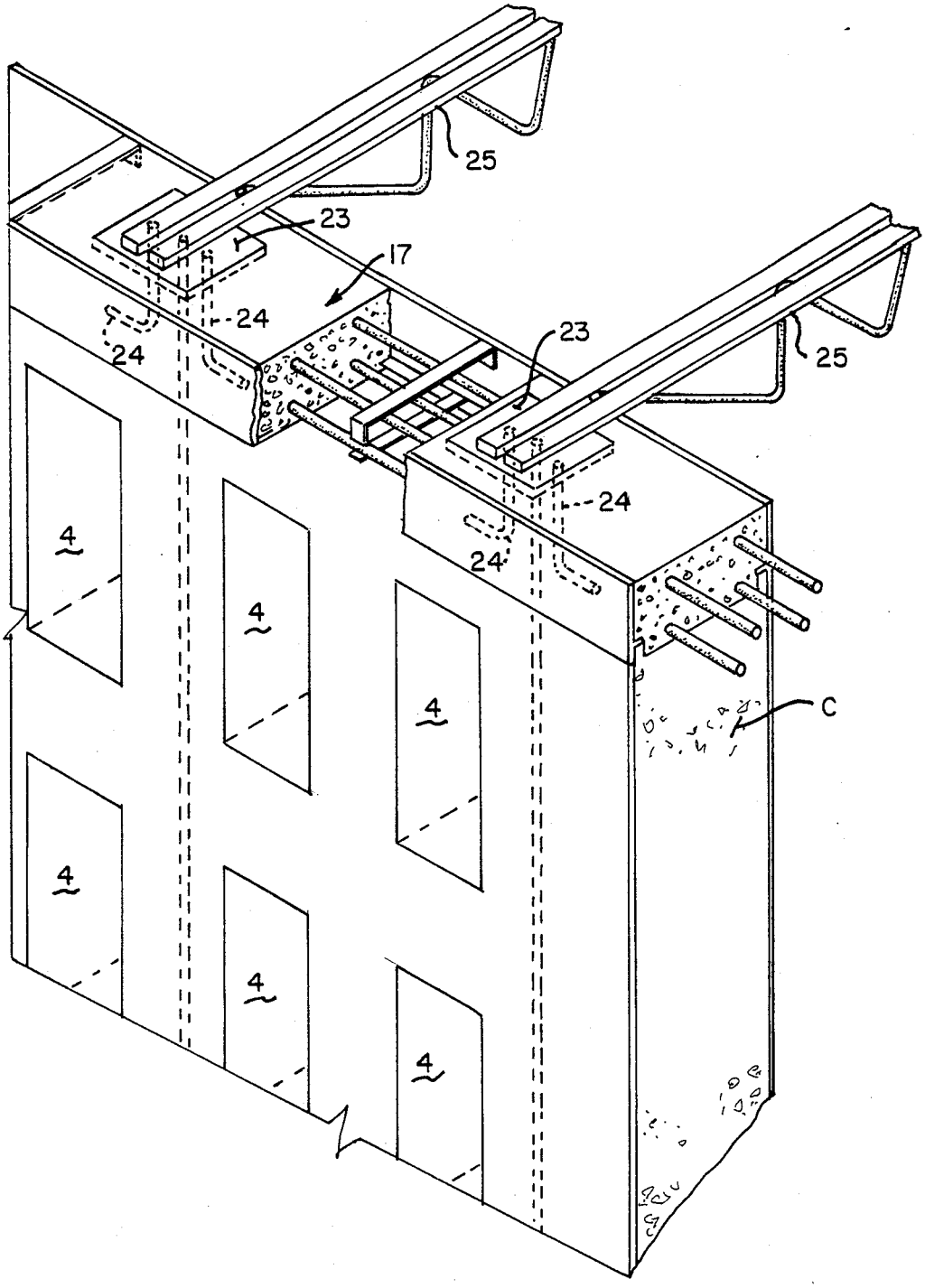
FIG. 7 discloses an isometric view of the upper edge of the composite wall of this invention, having its top beam plate cap arranged thereon, and incorporating header plates for supporting roof girders, as shown.

The FIG. 5 shows the erected wall forms, and in this particular instance being approximately three of them vertically stacked one upon the other, resting upon their footing 6, and the disposed L-shaped ties 8, and the tee-shaped ties 10 which are horizontally arranged and located intermediate the upper adjacent supported wall forms, as shown. The bracings 13, and their disposed fasteners 15, are likewise disclosed. As can be noted, concrete, as at C, being delivered by a chute is in the process of being poured into the latticework of voids located within the erected wall forms. In addition, as can be seen in FIG. 5, the top beam plate cap 17 has been conveniently formed into position, and essentially replaces any tee-shaped tie at this upper edge location, in order to provide a continuous poured concrete beam, at this location, which is integrally structured with the concrete latticework within the wall forms located there below, in order to afford a structurally reinforced beam, at this location, and upon which roof girders may be positioned. FIG. 5A discloses a cross section of the plate cap, wherein the side plates 18 generally at their lower positions have an equivalent configuration to the tee-shaped ties, but in this particular instance, the side plates extend upwardly, for that height desired for the fabricated top beam, being previously spaced apart by means of the series of tie means 19 and 20, as shown. These tie means are spaced at predetermined locations, between the side plates 18, as can be seen FIG. 5. Reinforcing rods may be positioned upon the lower tie means 20, and additional reinforcement rebars 21 may be tied and suspended, as shown at 22, from the upper tie means 19 of the plate cap. As disclosed in FIG. 7, header plates 23 are positioned at particular locations along the length of the top beam, with these header plates being positioned by means of their stub shaft rebars 24 before the poured concrete sets. And, upon the erection of the building, roof rafters 25 may be positioned at particular dimensions on center with respect to each other, along the length of the building, in order to provide support for any roof to be assembled thereon This drawing also incorporates the uniqueness of the constructed latticework for the reinforced concrete C, after its curing, with the previously disposed series of positioning blocks or spacer means 4 therein, of the styrene wall forms as conveniently embedded within and integrally forming a part of the composite and monolithic structure.

Figure 6:
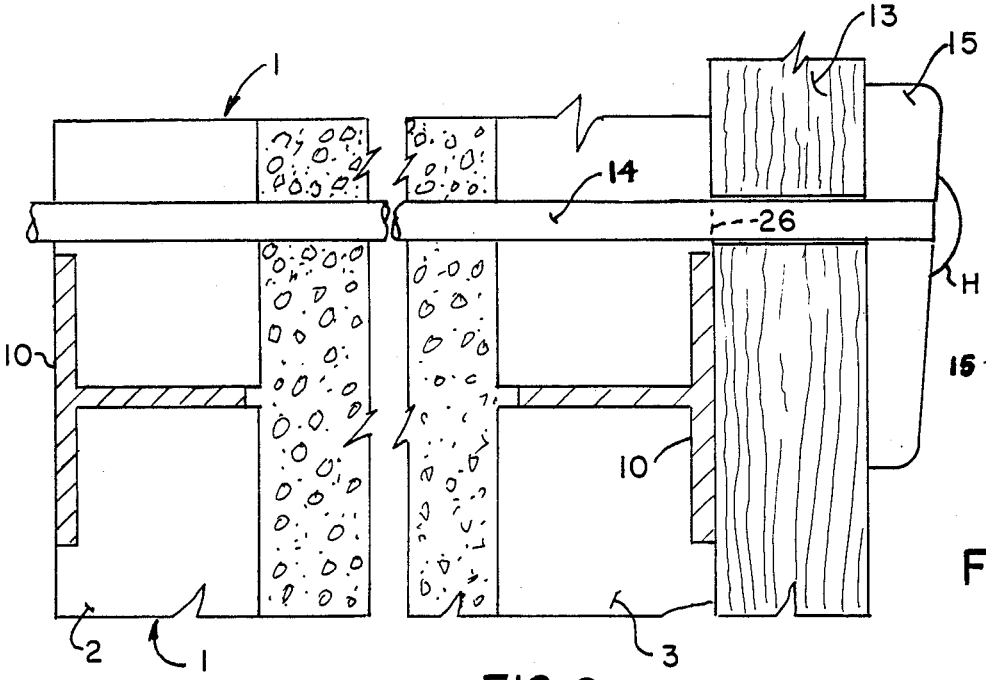
FIG. 6 provides a sectional view through a formed wall, and disclosing a pair of tee-shaped ties, a brace, and the fasteners removably secured to a tie means, used to reinforce the formed wall in preparation for, during, and after pouring of concrete occurs.
Figure 6A:
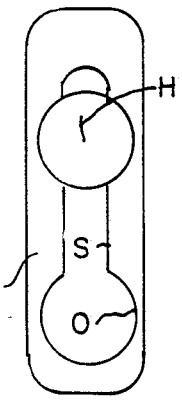
FIG. 6A is an end view of the removable fastener, and its tie means, as shown in FIG. 6.

FIGS. 6 and 6A provide an additional view of the relationship between the wall form units 1, the tee-shaped ties 10, and the tie means 11 that extend through the wall forms, and their associated braces 13 for being tightening and held in position by means of the beveled fasteners 15, as disclosed. These fasteners are readily available in the art, generally geing called dogs or cats heads, and simply incorporate a beveled surface, having a slot S therethrough, communicating with an enlarged opening 0, through which the head H of the tie means 11 inserts, and slides, until it tightly binds against the bracing 13, as can be seen. Once the wall has been formed, the concrete poured, and sets, a hammering of the removable fastener 15, as from its bottom, as shown in FIG. 6, disengages it from its binding against the bracing 13, loosens it from the fastening means head H, for its removal. Then, the fastening means may simply be broken off, as at the location 26, to be flush with the outer surface of the sheet 3, or 2, of the wall forms 1.

Figure 8:
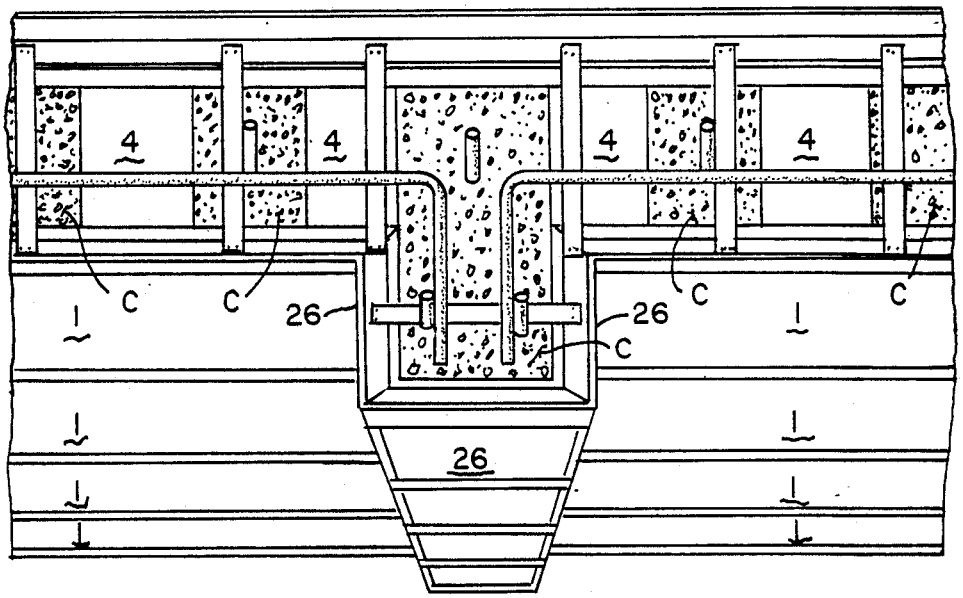
FIG. 8 is an oblique view, from above, showing a formed wall, after concrete is poured therein, and further disclosing how a column may be integrated into the structure of the wall for strength reinforcement.

Various modifications to the structure of the application of the wall forms of this invention may likewise be made. These modifications, such as shown in FIG. 8, include the shaped locating of smaller forms, as at 26, either interiorly or exteriorly of the disposed units 1, so as to form a pilaster, into which concrete may be poured, being fully reinforced in its erection, as shown by the plurality of rebars extending therein, and in this manner provides an additional support so as to enhance its reinforcement against wind velocity, and even earthquakes, and other abrupt forces exerted upon the building, during its useful life.

Figure 9:
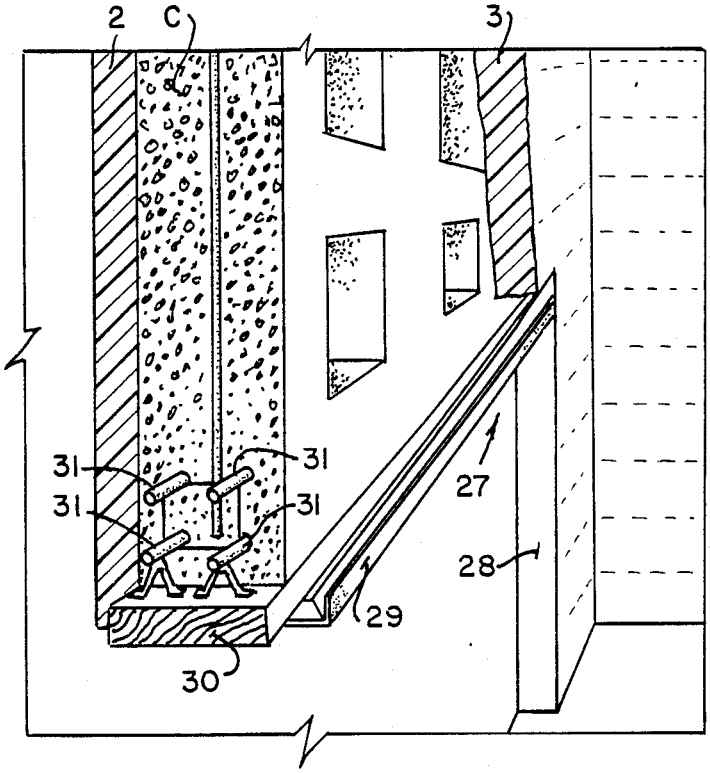
FIG. 9 is an isolated partial view of a formed wall, and showing header and jamb structure for forming a window or door aperture within the constructed wall.

FIG. 9 discloses the relationship of the sheets 2 and 3, of the wall forms, with the poured concrete C therein, and which is conveniently shaped, during the erection of the wall forms, so as to provide an aperture, as at 27 and therein furnish either a window, or door, for access into or out of the completed building. Various jamb forms 28 and header forms 29 in addition to the header board 30 may be shaped into position, once the wall forms are cut to the configuration of the intended and dimensioned door or window access, and then reinforcements, as shown at 31, may be conveniently positioned, in preparation for the pouring of the concrete C, so as to provide a reinforced header structure for the building aperture.

Figure 10:
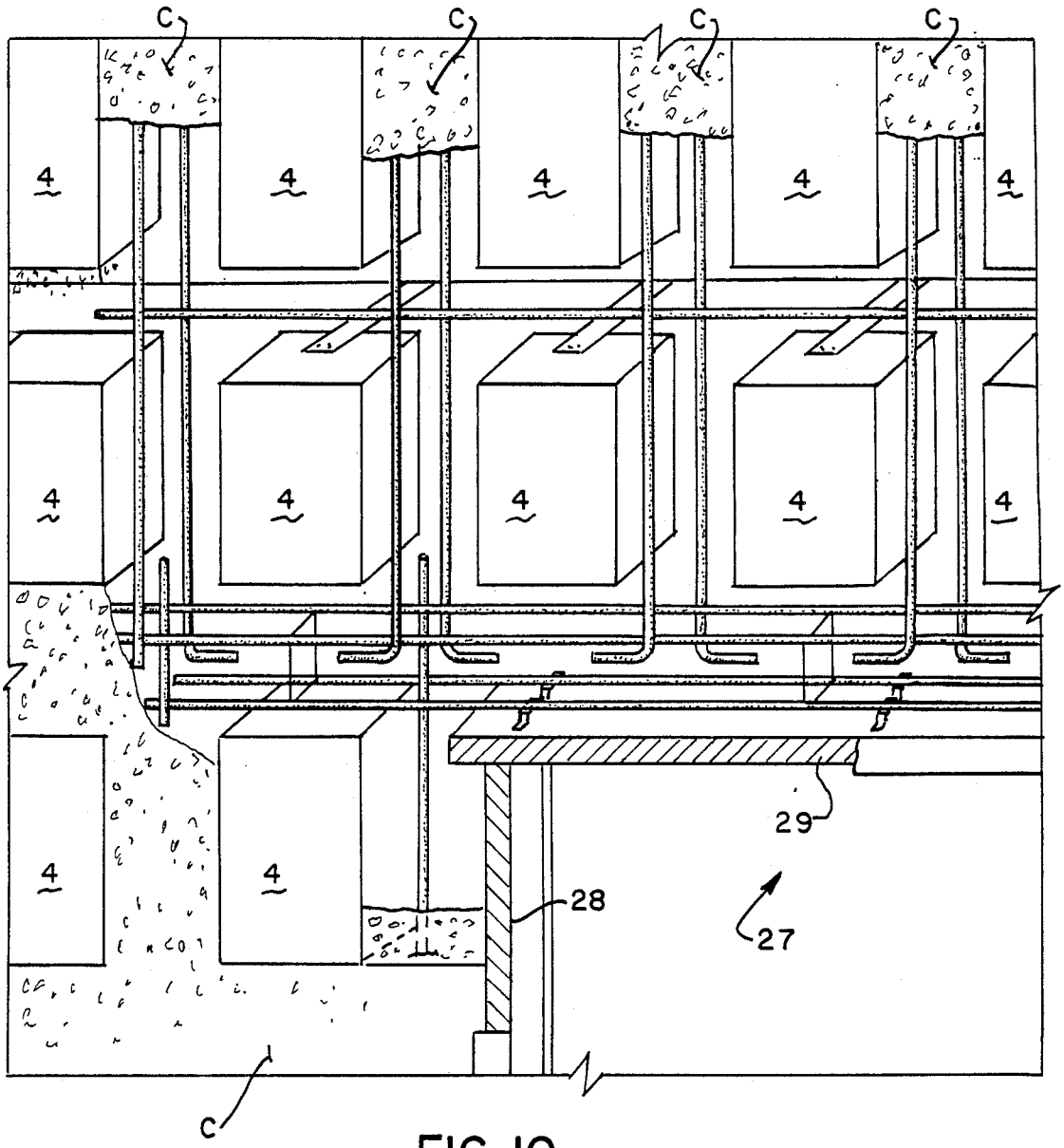
FIG. 10 shows a sectional view wherein the interior sheet of the wall form is removed, showing the emplacement of reinforcing rods therein, concrete partially in place, and the jamb and header portion of a door aperture.

FIG. 10 provides a further view of an assembled wall structure, similar to that as shown in FIG. 9, disclosing the relationship of the wall form blocks or spacer means 4, with the reinforced concrete C latticework provided therethrough, and the jamb 28 and header 29 positioned for accommodating the arrangement of the aperture 27 for the structured building.

In any event, the assembled wall, from its various wall forms 1, its tee and L-shapped ties, supporting them in position, aligned upon a footing, and the constructed top beam is readily disclosed in the variety of drawings as furnished in this disclosure. And, as previously summarized, once the building is structured, incorporating its latticework of fully reinforced concrete, the wall form units remain in position, having their sheets 2 arranged exteriorly of the formed wall, while the interior sheet 3 is permanently affixed thereto. In addition, and as earlier summarized various applications of interior or exterior facades may be applied to the sheets 2 and 3, such as the application of a laminated polymer or plastic to the interior surface of the sheet 3, to provide it with a finished appearance, and which may also be useful for use under low temperature conditions, or dry wall may be connected to the tee-shaped ties, in the manner as known in the art, to provide a finished wall interiorly of the building, and to which paint, wallpaper, or the like, can be applied. Furthermore, the exterior of the building may have a vapor barrier applied thereto, and then a facade of brickwork, or other material, applied there against to provide an exterior for the fabricated building. Or, in the alternative, a latticework or netting or wire may be applied over the exterior surface of the sheet 2, and stucco or other plaster applied thereto, to provide that type of exterior finished surface for the constructed building.

Variations or modifications to the structure of this invention, its application, and method of usage, may occur to those skilled in the art upon reviewing the subject matter of this invention. Such variations or modifications, if within the spirit of this invention, are intended to be encompassed within the scope of any claims to patent protection issuing upon this development. The description of the preferred embodiment set forth herein, is done so for illustrative purposes only.

Having thus described the invention, what is claimed and desired to be secured to Letters Patent is:

1. In an integral polymer and cement building or other structured wall form wherein forms prefabricated of polymer and the like are constructed and assembled as wall forms, and braced into position for reception of concrete therein for creation of such a composite wall, the improvement which comprises, each wall form fabricated of an extensively sized pair of sheets of polymer and spaced apart in the constructed wall a predetermined distance for forming a location for pouring of a quantity of concrete therein, a series of polymer blocks disposed between the arranged sheets, and with said blocks being integrally formed extending from the innerface of at least one of said sheets, said blocks being located at predetermined distances from each other so as to provide in the wall form construction a latticework of substantially sized communicating voids into which concrete may be deposited to form a monolithic wall constructed of concrete and the polymer wall forms, the constructed wall incorporating therein a latticework of formed concrete for reinforcement of said formed wall, and providing it with a degree of strength to function as a building wall, and for supporting of a roof or other structure thereon, said combination of the concrete latticework and the arranged polymer sheets and the blocks being integrally constructed into the formed wall for enhancement of its insulation, the formed polymer sheets and blocks being prefabricated of at least one of a polystyrene and urethane foam, the arranged sheets and blocks providing the wall forms having a series of reinforcing rods arranged therein for increasing the structural strength of any formed composite wall, there being a plurality of such wall forms forming each fabricated wall, wherein each adjacent set of vertically stacked wall forms having an exteriorly disposed and approximately horizontally arranged supporting tie between their polymer sheets to assure their alignment and the connection of said contiguous wall forms together during its assembly, wherein the supporting tie between each wall form sheet being a tee shaped tie, and a series of straps arranged across each pair of parallel arranged ties adjoining and aligning the pairs of sheets fabricated of the vertically arranged wall forms together, said wall forms at their bottom edges arranged upon a footing, and there being an exteriorly disposed supporting tie resting upon the footing and positioning and locating each sheet of said arranged wall form upon the same, the supporting ties between each wall form and footing being an L-shaped tie, a series of straps arranged across each pair of parallel arranged L-shaped ties adjoining and aligning the pair of sheets of the contiguous wall form as supported upon the subjacent footing, said L-shaped ties setting the perimeter for the building wall, vertical bracing provided at each juncture between adjacent wall forms and aligned at their interior and exterior thereof, tie means extending between each aligned bracing and temporarily securing the same together, removable fasteners cooperating with the tie means to temporarily secured the bracings in place during wall formation, said fasteners and bracings being removable, and with said tie means remaining intact within the formed composite concrete the polymer wall.

2. The invention of claim 1 and wherein a pair of adjacent wall forms being fabricated into a building corner.

3. The invention of claim 2 and wherein the sheets forming each wall form at a corner being beveled to complimentary fit into the shape of the designed corner.

4. The invention of claim 3 and wherein said bevel being formed at an approximate forty-five degree angle.

5. The invention of claim 4 and wherein select of said reinforcing rods angularly turn at the formation of a building corner.

6. The invention of claim 1 and wherein select of said reinforcing rods being anchored within said footing.

7. The invention of claim 1 and wherein said pair of sheets forming each wall form being an inner and outer sheet, with the inner sheet being of lesser density than the other sheet.

8. The invention of claim 7 and wherein said inner sheet being formed of approximately one pound density polystyrene, and said outer sheet being formed of approximately two pound density polystyrene.

9. The invention of claim 1 and wherein select of said arranged integral blocks extending beyond the edge of their wall formed sheets to stradle within the pair of sheets of the next adjacent wall form forming a building wall.

10. The invention of claim 7 and wherein said inner sheet upon its interior surface having a plastic laminated thereon.

11. The invention of claim 7 and wherein said inner sheet upon its interior surface of the wall formed having an applied surface.

12. The invention of claim 11 and wherein said interior surface of the sheet having dry wall applied adjacent thereto.

13. The invention of claim 11 and wherein the wall forms having an inner surface, and dry wall being applied to said inner surface.

14. The invention of claim 13 and wherein said dry wall being affixed to said supported ties.

15. The invention of claim 1 and wherein said wall forms having an outer surface, and an exterior facade being applied to said disposed outer surface.

16. The invention of claim 5 and wherein said outer facade being stucco.

17. The invention of claim 14 and wherein said outer face being brick.

18. The invention of claim 14 and wherein said outer facade being siding.

19. The invention of claim 11 and there being at least one aperture provided through a formed wall to accommodate access into a constructed building.

20. The invention of claim 19 and wherein said aperture being framed with at least one jamb and header.

21. The invention of claim 20 and wherein said aperture being a door.

22. The invention of claim 20 and wherein said aperture being a window.

23. The invention of claim 1 and wherein said combined wall forms having an upper edge and a top beam plate cap provided upon said upper edge.

24. The invention of claim 23 and including a series of girders provided upon the said cap to support a building roof or other structure.

25. The invention of claim 23 and wherein said cap having reinforcement therein.

26. The invention of claim 25 and wherein said reinforcement comprising a series of reinforcing rods.

27. The invention of claim 24 and including a header plate provided between each support girder and the top beam plate cap.

* * * * *

UNITED STATES PATENT AND TRADEMARK OFFICE

CERTIFICATE OF CORRECTION

PATENT NO. : 4,924,641

DATED : May 15, 1990.

INVENTOR(S) : James H. Gibbar, Jr.

It is certified that error appears in the above—identified patent and that said Letters Patent is hereby corrected as shown below:

Column 14, claim 5, line 34, change "4" to ---2---.

Column 14, claim 7, line 42, change "other" to ---outer---.

Column 14, claim 13, line 61, change "11" to ---1---.

Column 15, claim 16, line 1, change "5" to ---15---.

Column 15, claim 19, line 1 of claim 19, change"14" to ---1---.

Signed and Sealed this

Twentieth Day of August, 1991

*Attest:*

HARRY F. MANBECK, JR.

*Attesting Officer*

*Commissioner of Patents and Trademarks*